US012447394B2

(12) United States Patent
Fechser

(10) Patent No.: US 12,447,394 B2
(45) **Date of Patent: *Oct. 21, 2025**

(54) GAME SYSTEM

(71) Applicant: Ted J. Fechser, Las Vegas, NV (US)

(72) Inventor: Ted J. Fechser, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/219,751

(22) Filed: Jul. 10, 2023

(65) Prior Publication Data

US 2024/0149143 A1 May 9, 2024

Related U.S. Application Data

(60) Continuation of application No. 17/672,600, filed on Feb. 15, 2022, now Pat. No. 11,724,176, which is a continuation of application No. 16/781,422, filed on Feb. 4, 2020, now Pat. No. 11,253,774, which is a continuation of application No. 15/960,922, filed on Apr. 24, 2018, now Pat. No. 10,576,364, which is a division of application No. 15/497,004, filed on Apr. 25, 2017, now Pat. No. 9,999,829.

(60) Provisional application No. 62/437,565, filed on Dec. 21, 2016.

(51) Int. Cl.

| | |
|---|---|
| ***A63F 9/24*** | (2006.01) |
| ***A63F 3/00*** | (2006.01) |
| ***A63F 7/02*** | (2006.01) |
| ***A63F 7/30*** | (2006.01) |
| ***A63F 11/00*** | (2006.01) |
| ***G06F 13/00*** | (2006.01) |
| ***G06F 17/00*** | (2019.01) |

(52) U.S. Cl.
CPC ..... *A63F 3/00097* (2013.01); *A63F 3/00261* (2013.01); *A63F 7/02* (2013.01); *A63F 7/30* (2013.01); *A63F 2003/00435* (2013.01); *A63F 2003/00485* (2013.01); *A63F 2003/00583* (2013.01); *A63F 2007/301* (2013.01)

(58) Field of Classification Search
CPC ... G07F 17/32; G07F 17/3211; G07F 17/3214
USPC ..... 463/10, 12, 15, 20, 22, 25
See application file for complete search history.

(56) References Cited

U.S. PATENT DOCUMENTS

| | | | | |
|---|---|---|---|---|
| 2002/0067000 | A1* | 6/2002 | Larson | A63F 3/00075 273/255 |
| 2007/0063435 | A1* | 3/2007 | Tippy | A63F 3/00 273/243 |
| 2015/0251083 | A1* | 9/2015 | Wright | A63F 3/0457 273/242 |

* cited by examiner

*Primary Examiner* — Adetokunbo O Torimiro
(74) *Attorney, Agent, or Firm* — Snell & Wilmer L.L.P.

(57) ABSTRACT

A game system may comprise a board comprising a plurality of pegs extending from the board, wherein the pegs may be disposed in rows; at least one deflector configured to be coupled to at least two pegs aligned with one another; at least one ball configured to move on the board between and/or along the pegs and deflector(s) from a start end to a goal end of the board; at least one goal configured to be coupled to at least two pegs in a goal row of the rows of pegs, wherein the goal is configured to receive a ball; and a plurality of play selectors which determine a play for each player during a turn of a game. The goal of the game may be to get a ball into a goal by navigating across the board having the pegs and deflectors as obstacles to movement of the ball.

14 Claims, 10 Drawing Sheets

GAME SYSTEM

CROSS REFERENCE TO RELATED APPLICATIONS

This application is a Continuation of, and claims priority to and the benefit of, U.S. patent application Ser. No. 17/672,600, filed Feb. 15, 2022 and entitled "GAME SYSTEM," which is a Continuation of, and claims priority to and the benefit of, U.S. patent application Ser. No. 16/781,422, filed on Feb. 4, 2020 and entitled "GAME SYSTEM," now U.S. Pat. No. 11,253,774 issued on Feb. 22, 2022, which is a Continuation of, and claims priority to and the benefit of, U.S. patent application Ser. No. 15/960,922, filed Apr. 24, 2018 and entitled "GAME SYSTEM," now U.S. Pat. No. 10,576,364 issued on Mar. 3, 2020, which is a Divisional application of, and claims priority to and the benefit of, U.S. patent application Ser. No. 15/497,004, filed Apr. 25, 2017 and entitled "GAME SYSTEM," now U.S. Pat. No. 9,999, 829 issued on Jun. 19, 2018, which is a nonprovisional application of, and claims priority to and the benefit of, U.S. Provisional Patent Application Ser. No. 62/437,565, filed Dec. 21, 2016 and entitled "GAME SYSTEM," all of which are incorporated by reference herein.

FIELD

The present disclosure generally relates to a game system, and more specifically to a game system involving releasing a ball(s) on a board comprising obstacles in order to get the ball into a goal.

BACKGROUND

It is a popular activity for individuals to entertain themselves by playing organized instruction-based games, particularly games involving strategy, intellect, opposition, and the like. There are, therefore, a wide variety of games employing various modes of play and requiring varying degrees of strategy and intellect. In different embodiments, such games can include multi-player games, single-player games, and games played on and/or against a computer. Additionally, such instruction-based game sets are readily available ranging from games with a simple mode of play or singular game element such as dropping a ball on a board with an obstacle, to complex modes of play with multiple layered game elements such as a play selector(s), moveable obstacles, etc. Many of these games are turn-based and involve multiple players.

SUMMARY

In various embodiments, a game system may comprise a board comprising a plurality of pegs extending from the board, wherein the pegs may be disposed in rows; at least one deflector configured to be coupled to at least two pegs aligned with one another; at least one ball configured to move on the board between, along, and around the pegs and deflector(s) from a start end to a goal end of the board; at least one goal configured to be coupled to at least two pegs in a goal row of the rows of pegs, wherein the goal is configured to receive a ball; and a plurality of play selectors which determine a play for each player during a turn of a game.

During play of a game system with one or more players, in accordance with various embodiments, one or more goals may be placed at a goal end of a board, wherein the board may comprise pegs extending from the board in rows. Each player may receive one or more play selectors at the beginning of the game, and/or during each turn. The play selectors may dictate what play a player may make during a turn of the game. During a turn of the game, each player may make a play associated with at least one play selector the player has received (e.g., place a deflector on the board, move, remove, or pivot a deflector already on the board, etc.). Finally, during a turn, each player may release a ball from a start end of the board so the ball may move from the start end, between the pegs and deflector(s), and come to rest at the goal end of the board. A point is awarded to a player in response to a ball coming to rest in a goal associated with the player. At the end of the game, which may be dictated by the number of turns, the player with the most points is the winner.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of various embodiments herein makes reference to the accompanying drawings, which show the exemplary embodiments by way of illustration. While these exemplary embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component or step may include a singular component or step. Also, any reference to attached, fixed, connected or the like may include permanent, removable, temporary, partial, full and/or any other possible attachment option.

For the purposes of the invention disclosed herein, the terminology "game rules" means rules, guidelines, and/or methods dictating interaction amongst the players of a game system, and the interactions between the components of a game system. Such terminology is interchangeable with the terms "game play" or "play-of-game" or "game" or "game instructions" or "game methods" or the like.

Figure 1:
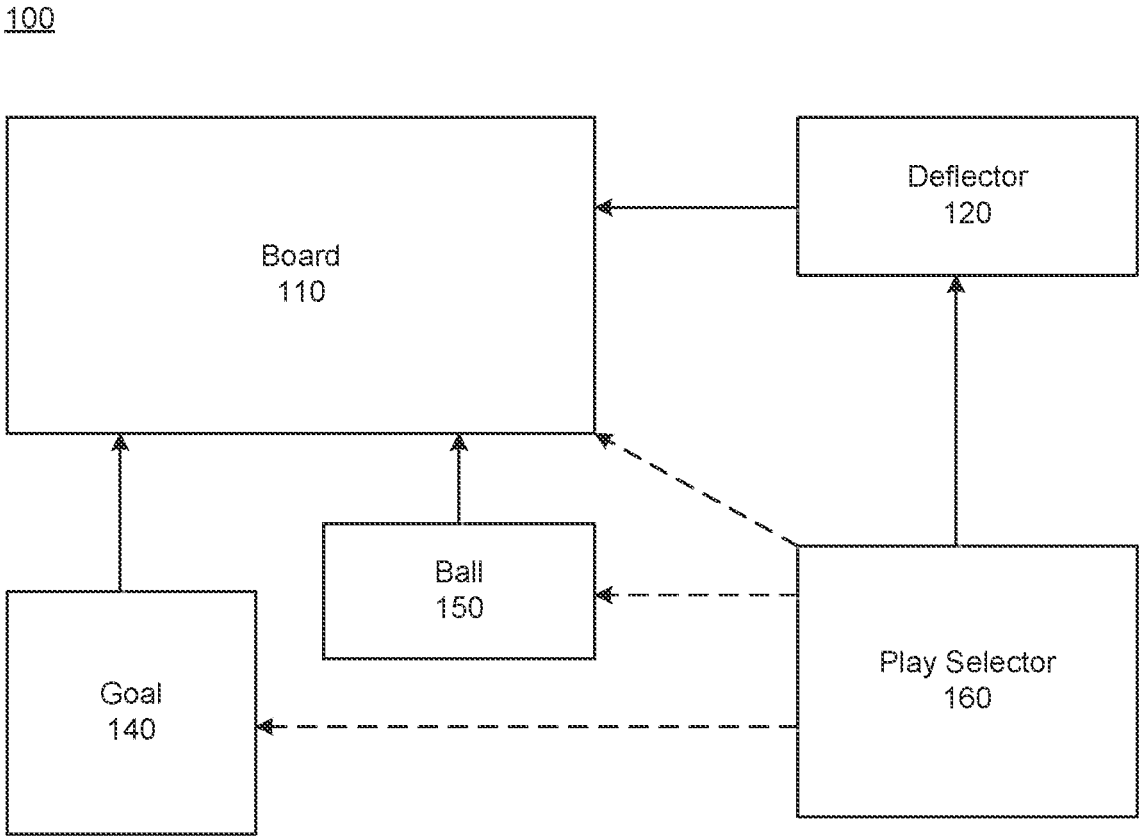
FIG. 1 depicts a block diagram of exemplary game system, in accordance with various embodiments.

With reference to FIG. 1, a block diagram of an exemplary game system 100 is depicted, in accordance with various embodiments. In various embodiments, game system 100 may comprise a board 110, at least one deflector 120, at least one goal 140, at least one ball 150, and at least one play selector 160.

In various embodiments, game system 100 may comprise a board 110 with pegs arranged in rows. The pegs may be arranged such that a ball 150 may move along board 110 between the pegs toward one or more goals 140, and pegs may change the direction of ball movement in response to the ball contacting a peg(s). Board 110 may be inclined to facilitate movement of a ball 150 from a start end to a goal end of board 110. The goal(s) 140 may be coupled to at least two pegs in a goal row of the rows of pegs, which may be disposed at a goal end of board 110. Goals 140 may be configured to receive a ball 150. A goal 140 may be associated with each player, such that if a ball 150 is received by a goal 140, the player associated with that goal 140 receives a point or a number of points. Player(s) may place one or more deflectors 120 on board 110 by coupling deflector(s) 120 to two or more pegs which may be aligned or adjacent to one another. Deflector(s) 120 may not move substantially in response to being contacted by a ball 150. Instead, deflector(s) 120 may be objects configured to change the direction of the ball 150 as a result of such contact. Therefore, a player may dispose a deflector(s) 120 such that, during ball traversal or movement on board 110, the deflector(s) 120 will direct a ball 150 toward the player's goal 140, or direct a ball 150 away from an opposing player's goal 140.

In various embodiments, each player may make one or more plays during a turn of a game. The plays may be dictated by play selectors 160. Play selectors 160 may be a die or dice and the sides of the die or dice, a spinner and portions of the spinner chart, cards, or any other suitable object configured to communicate to a player what play to make. For example, a play selector 160 may dictate to a player to dispose a deflector 120 on board 110. In response, the player may decide where to dispose the deflector 120 on board 110, and couple the deflector 120 to pegs on board 110. During a turn, each player may release a ball 150 from the start end of board 110, and the ball 150 may move toward the goal end of board 110, physically contacting pegs and deflectors 120 coupled to board 110, which may change the ball's 150 direction of movement. In response to the ball 150 reaching the goal end of board 110, the ball 150 may come to rest either inside or outside of a goal 140. In response to the ball 150 coming to rest in a goal 140, the player associated with that goal 140 may be awarded a point or a number of points associated with a goal.

In various embodiments, board 110 may be a panel upon which other components of game system 100 may be disposed and/or interact. For example, with combined reference to FIGS. 1 and 2, board 210 (an example of board 110 in FIG. 1) of a game system 200 may have a board plane 212, to which a plurality of pegs 214 are coupled, and on which a ball 250 (an example of ball 150 in FIG. 1) may move (e.g., roll) along board plane 212 between pegs 214. Board plane 212 may be flat, convex, concave, or any other suitable shape, or board plane 212 may comprise bumps, grooves, waves, and/or any combination thereof, or any other differentiation from a flat or smooth surface. Board 110 may be made of polymeric material, acrylic, metal, wood, or any other suitable material creating a surface on board plane 212 which would allow a ball 250 to traverse or otherwise move across. A desired amount of friction in the interaction between board plane 212 and a ball 250 may be achieved by selecting particular materials.

Figure 2A:
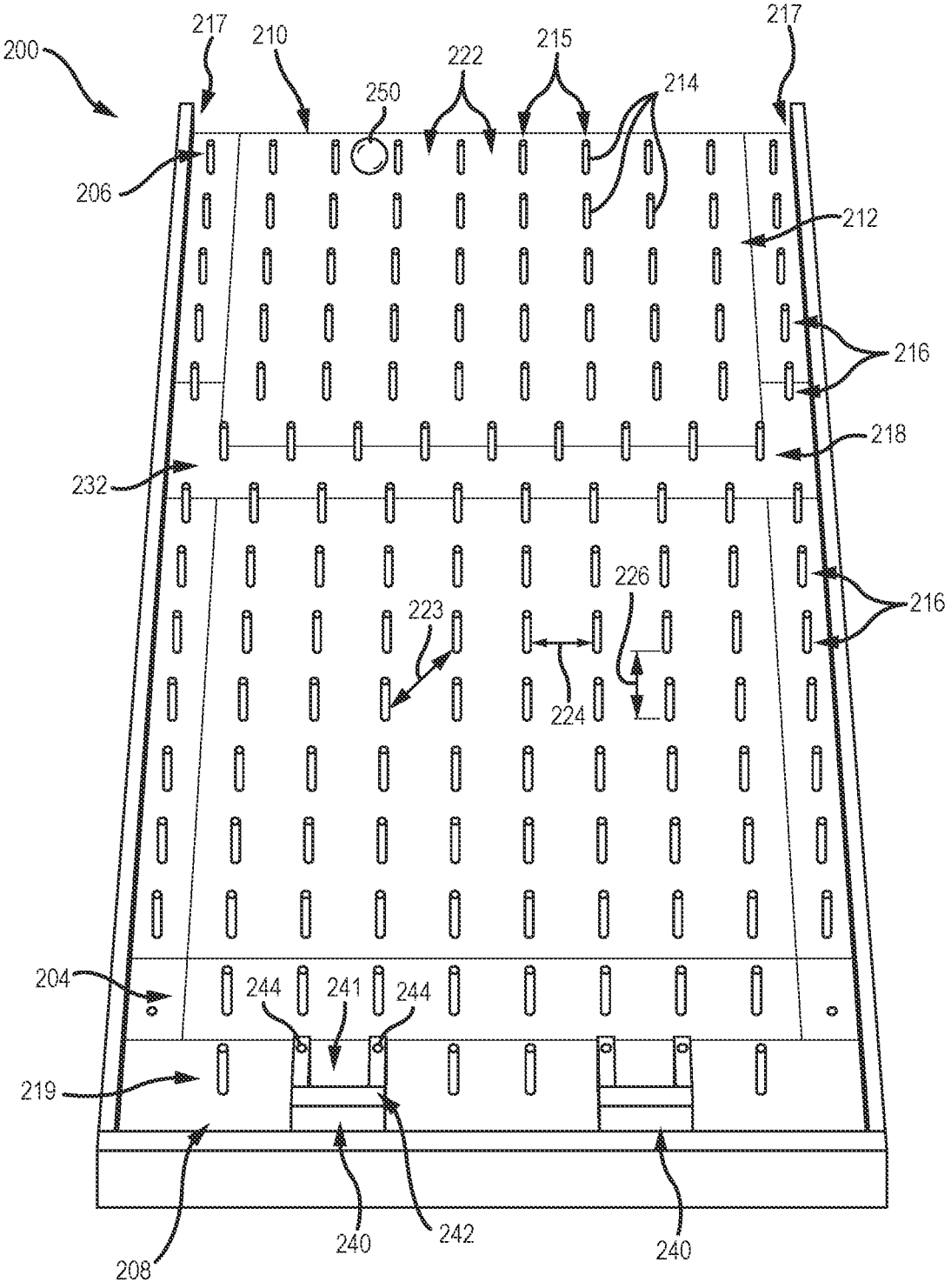
FIG. 2A depicts a front perspective view of a game system, in accordance with various embodiments.
Figure 2B:
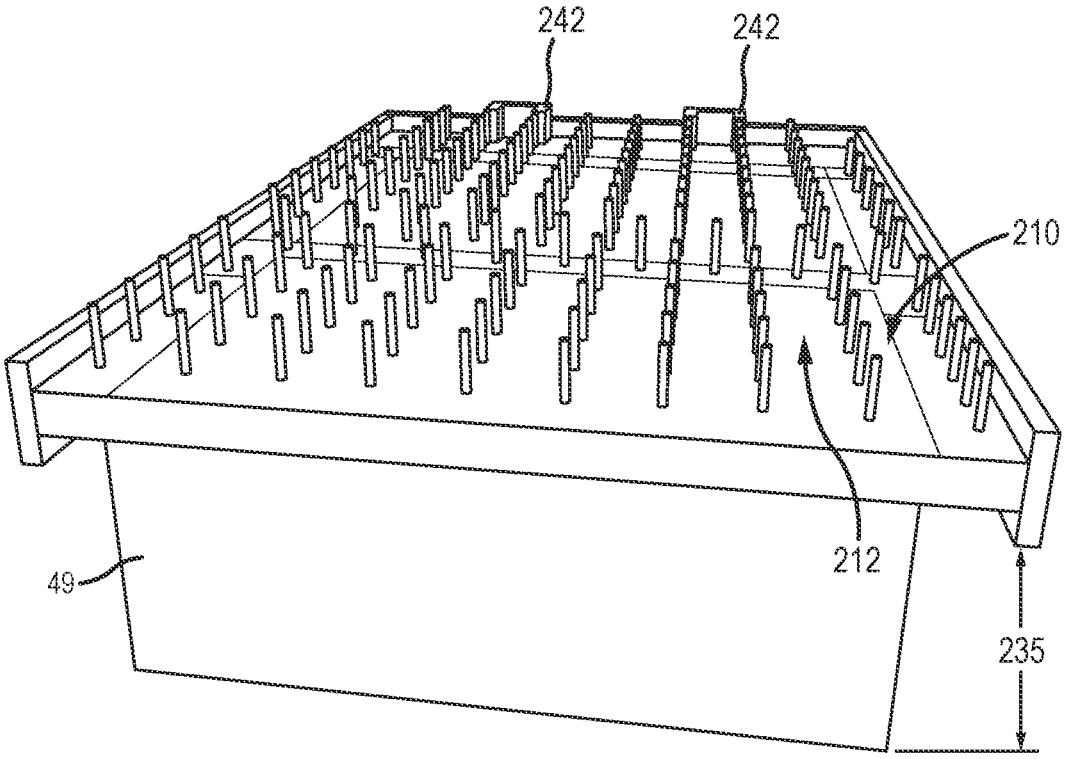
FIG. 2B depicts a rear perspective view of a game system, in accordance with various embodiments.

In various embodiments, with added reference to FIG. 2B, game system 200 may further comprise a base 49 coupled to board 210. Base 49 may cause board 210 to be elevated such that board plane 212 is at an angle 235 relative to a horizontal plane. That is, base 49 may be coupled to start end 206, or any other suitable location on board 210, such that start end 206 of board plane 212 is elevated. Angle 235 may be any suitable angle. For example, board may be elevated from horizontal such that board plane 212 has an angle of between about 10° and about 60° from horizontal, between about 10° and about 45° from horizontal, between about 10° and about 30° from horizontal, or any suitable angle 235 from horizontal. As used in this context only, the term "about" means plus or minus 5 degrees. Such an elevation may be configured to facilitate ball 250 traversing or moving along board plane 212 during game play.

In various embodiments, pegs 214 may be coupled to board 210, and positioned substantially perpendicular to board plane 212. As used in this context only, "substantially perpendicular" means within 10° from one of pegs 214 forming a 90° angle with board plane 212. Pegs 214 may be arranged on board 210 in any suitable configuration such that ball 250 may move between pegs 214 when moving along board plane 212. Pegs 214 may be configured to be minimal or passive obstructions for ball 250 moving along board plane 212 such that pegs 214 may change the direction of travel of ball 250 in response to physical contact between a peg 214 and ball 250. In various embodiments, a player may be awarded a point(s) for each peg 214 that ball 250 contacts during a turn. In various embodiments, some or all of pegs 214 may be rods having a cross section of any suitable geometric shape (e.g., circular, square, rectangular, octagonal, hexagonal cross section, etc.). In various embodiments, some or all of pegs 214 may be any other suitable obstruction for ball 250 on board plane 212, such as bumps, blocks, or the like.

In various embodiments, pegs 214 may be disposed in substantially parallel rows 216 between a start end 206 and goal end 208 of board plane 212 (rows 216 may be "horizontal" in response to viewing board 210 where start end 206 is at the top of the view and goal end 208 is at the bottom of the view). Rows 216 may be substantially parallel to start end 206 and/or goal end 208, wherein the term "substantially parallel," as used in this context only, means plus or minus 10 degrees from parallel to start end 206 and/or goal end 208. Rows 216 may span between outer edges 217 of board plane 212. Pegs 214 in one row 216 may be aligned with pegs 214 in one or more other rows 216 such that some or all of pegs 214 in rows 216 create cross rows 215 spanning between start end 206 and goal end 208. The arrangement of pegs 214 to form cross rows 215 may create pathways 222 between cross rows 215 in which ball 250 may traverse or move along board plane 212.

In various embodiments, one or more horizontal rows 216 may be an offset row 218. Offset row 218 may comprise pegs 214 disposed in an arrangement different than other rows 216 such that pegs 214 in offset row 218 may not be part of cross rows 215. Therefore, pegs 214 in offset row 218 may provide obstructions in pathways 222. In various embodiments, offset row 218 may be marked by any suitable marking on board plane 212. As depicted in FIG. 2A, offset row 218 may be marked by red row 232. In various embodiments, there may be more than one offset row 218. For example, board 210 may comprise one offset row 218 on a half of board plane 212 that is more proximate to start end 206, and another offset row 218 on a half of board plane 212 that is more proximate to goal end 208. In various embodiments, offset row(s) 218 may only comprise pegs 214 that obstruct pathways 222 for a portion of the row 216 comprising offset pegs 214. For example, an offset row 218 may only have offset pegs 214 obstructing pathways 222 for half of the offset row 218, and the other half may have pegs aligned with cross rows 215. In various embodiments, an offset row 218 may comprise pegs shaped differently than pegs 214 in other rows 216 (e.g., pegs having larger cross sections, i.e., thicker, different shaped cross sections, or the like), or there may be more or fewer pegs 214 in an offset row 218.

In various embodiments, board 210 may be divided into pieces that may be arranged in any desired configuration to form board 210 with a desired arrangement of pegs 214 and rows 216. For example, board 210 may be divided into pieces, with each piece comprising any desired number of rows 216. In such embodiments, the pieces of board 210 may be disposed in any arrangement to create a board plane 212 with a desired arrangement of pegs 214. Such embodiments may allow players of game system 200 to choose the length or width of board plane 212 ball 250 will travel between a start end 206 and a goal end 208, the arrangement of pegs 214, and/or the number and placement of rows 216 and offset row(s) 218 on board plane 212. In various embodiments, offset row(s) 218 may be comprised on pieces of board 210 that comprise no other rows 216. For example, some pieces of board 210 may comprise rows 216, which may not include an offset row(s) 218, while other pieces of board 210 may only include an offset row 218. As such, one or more offset rows 218 may be moved up or down on board 210 between start end 206 and goal end 208, which may occur before, during, and/or after game play.

In various embodiments, with continued reference to FIG. 2A, game system 200 may comprise one or more goals 240 (an example of goal 140 in FIG. 1). A goal 240 may be configured to span between two or more pegs 214 in a goal row 219 of rows 216. Goal row 219 may be disposed at or adjacent to goal end 208 of board plane 212. In various embodiments, goal(s) 240 may be disposed between at least two pegs 214 at any desired location on board plane 212 (e.g., in a row 216 not at or adjacent to goal end 208 of board plane 212). Goal 140 may comprise a goal wall 242, which may define a receptacle area 241. Goal wall 242 may comprise multiple components connected together, such as illustrated in FIG. 2A, or a single piece of material, such as illustrated in FIG. 2B. In various embodiments, goal wall 242 may be U-shaped, defining the receptacle area 241. Receptacle area 241 may be configured to receive ball 250 moving along board plane 212. During game play, in response to a ball 250 entering receptacle area 241 of a goal 240, the player associated with that goal 240 may receive a point or a number of points.

In various embodiments, goal(s) 240 may be coupled to pegs 214. A peg void 244 may be part of, or coupled to, goal wall 242. The shape of peg void 244 may be complementary to the cross-sectional shape of peg 214, such that a peg 214 may be inserted into peg void 244 for stability of the position of goal 240. Peg void 244 may be disposed completely through the height of goal wall 242, or partially through the height of goal wall 242. In various embodiments, goal wall 242 may be taller or shorter than pegs 214. Goal 240 may, once coupled to pegs 214, may rest adjacent to board plane 212. In various embodiments, goal 240 may be coupled to two adjacent pegs 214 in a row 216, or coupled to two pegs 214 having other pegs 214 between them. There may be any desired number of goals 240 disposed on board plane 212 as pegs 214 will allow. In various embodiments, the number of goals 240 on board plane 212 may match the number of players and/or teams playing game system 200.

Figure 3:
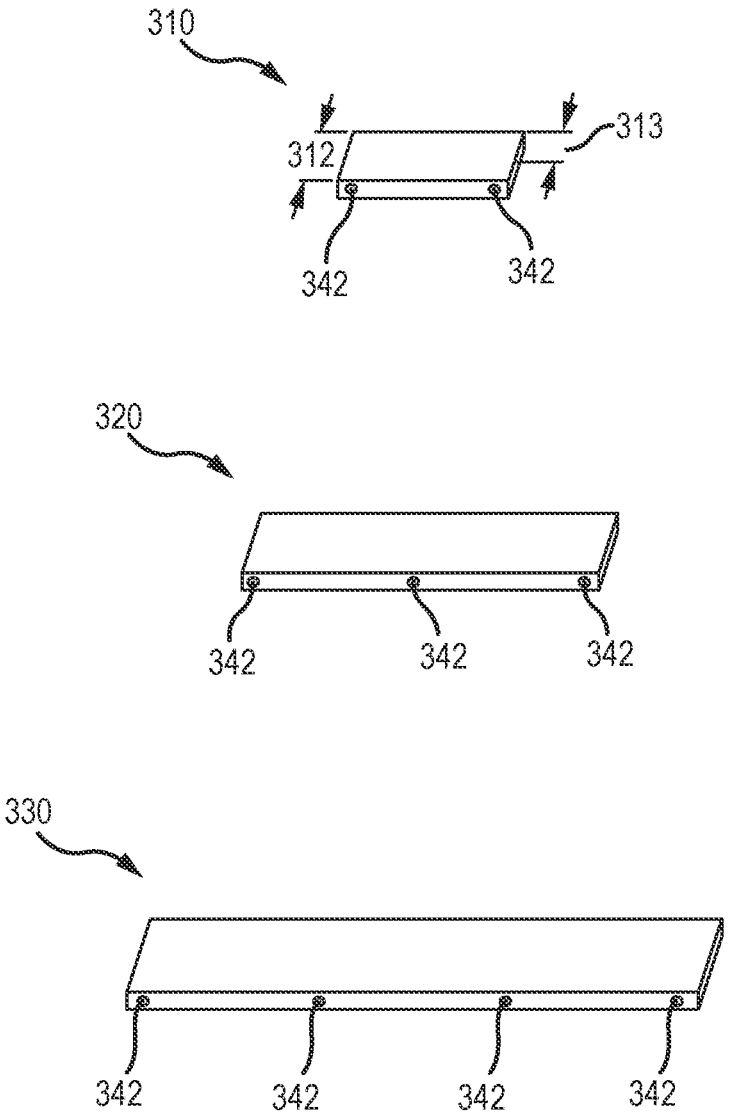
FIG. 3 depicts exemplary deflectors for a game system, in accordance with various embodiments.

In various embodiments, game system 200 depicted in FIG. 2A may comprise deflectors, such as deflectors 310, 320, and 330 depicted in FIG. 3. Deflectors may be comprised of any suitable material (e.g., polymeric material, elastomeric material, acrylic, metal, wood). With combined reference to FIGS. 2A and 3, deflectors may be objects configured to be coupled to at least two aligned pegs 214 and span between the at least two aligned pegs 214. In doing so, the deflectors may be configured to obstruct pathways 222 to change the direction of ball 250 while ball 250 is moving along board plane 212 from start end 206 to goal end 208. The deflectors may be slender objects, such that a ball 250 may travel between two adjacent and/or parallel deflectors on board plane 212. In various embodiments, deflectors may obstruct pathways 222 while being coupled to a single peg 214. Based on the material comprised in deflectors, the deflectors may exhibit different properties resulting in different responses to contact with a ball 250 moving along board plane 212. For example, a deflector comprised of an elastomeric material (e.g., rubber) may cause a spring or bounce affect in response to a ball contacting such a deflector, which may change the direction of ball movement more so than a ball contacting a rigid deflector (e.g., comprised of rigid metal, wood, polymeric material, etc.).

In various embodiments, single deflector 310 may span between two adjacent pegs 214, double deflector 320 may span between three aligned pegs 214, and/or triple deflector 330 may span between four aligned pegs 214. Stated another way, single deflector 310 may span one diagonal length 223, double deflector 320 may span two diagonal lengths 223, and/or triple deflector 330 may span three diagonal lengths 223. In various embodiments, deflectors may span horizontal length(s) 224 and/or vertical length(s) 226, which may be defined by the distances between any two or more pegs 214. In various embodiments, deflectors may span between any desired number of pegs 214, including spanning between greater than four aligned pegs 214. Deflectors, such as deflectors 310, 320, and 330, may be coupled to pegs 214 via peg voids 342 disposed through the deflectors for stability of the position of the deflectors, similar to peg voids 244 disposed in goal wall 242 of goal 240, as discussed herein.

In various embodiments, the deflectors comprised in game system 200 may be coupled to pegs 214 that are not aligned. The deflectors may comprise any suitable shape including portions of the deflectors spanning between any feasible combination of diagonal lengths 223, horizontal lengths 224, and/or vertical lengths 226. For example, a double deflector may span one diagonal length 223 and one horizontal length 224, or one diagonal length 223 and one vertical length 226. In various embodiments, double deflector(s) 320 and/or triple deflector(s) 330 (or any deflector greater than a single deflector) may comprise a hinge at a middle peg void 342 (a peg void 342 disposed between two other peg voids 342 in the deflectors). Therefore, in such embodiments, a deflector may be capable of being adjusted or pivoted about the hinge to span between different pegs 214 at different times. For example, double deflector 320 having a hinge at the middle peg void 342 may at one time span between two diagonal lengths 223, and at another time, be pivoted about the hinge to span one diagonal length 223 and one horizontal length 224 or vertical length 226.

In various embodiments, the deflectors of game system 200 may be single deflectors 310 which may be added to one another to create deflectors spanning between more than two pegs 214. For example, single deflector 310 may comprise a height 312. The ends of single deflector 310 may be a half height 313, or any other fraction height less than height 312. With the ends of single deflector 310 being half height 313 (or anything less than height 312), a first single deflector 310 may be disposed between two pegs 214, and then a second single deflector 310 may be disposed between two pegs 214, wherein the first and second single deflectors 310 may share a common peg 214. The first and second single deflectors 310 may each span in any desired direction (i.e., diagonal length 223, horizontal length 224, and/or vertical length 226). In such embodiments, any desired number of single deflectors 310 may be added together to span between any desired number of pegs 214 in any desired direction. Furthermore, any desired number of single deflectors 310 coupled together may be pivoted about a peg, while leaving other coupled single deflectors 310 in an original position.

In various embodiments, as part of the game rules of game system 200, deflectors may not be placed on or across offset row(s) 218, or adjacent to outer edges 217 of board plane 212 such that a ball moving from start end 206 to goal end 208 may get stuck between a deflector and an outer edge 217. As an additional part of the game rules, a player may not couple a deflector to a peg 214 in a goal tend row 204 (which may be adjacent to goal row 219) such that the disposed deflector blocks another player's goal 240. In various embodiments, one of the game rules may be that deflectors may only be disposed in a diagonal direction between pegs 214, such as diagonal length 223.

In various embodiments, with reference to FIG. 2A, game system 200 may comprise one or more balls 250 (an example of ball 150 in FIG. 1). Balls 250 may be any object configured to move along board plane 212 between start end 206 and goal end 208. In various embodiments, balls 250 may be comprised of any suitable material (e.g., metal, wood, polymeric material, glass, elastomeric material, etc.). A player may choose a ball 250 made out of a particular material so such the ball 250 will have a desired characteristic or effect. For example, if a player desires ball 250 to move more quickly along board plane 212, the player may select a metal ball because metal may be heavier than other materials, and therefore, more effectively gain speed during movement. In various embodiments, balls 250 may be any suitable shape for moving along board plane 212 (e.g., sphere, icosahedron, etc.). In various embodiments, at the end of each turn during game play of game system 200, each player may release a ball 250 from a location on start end 206 of board plane 212, which moves between pegs 214 and along and between deflectors disposed on board plane 212 to goal end 208, with the objective of getting the ball 250 in a desired goal 240. In various embodiments, ball 250 may be released at any location on board plane 212.

In various embodiments, game system 200 may comprise one or more play selectors (such as play selector 160 depicted in FIG. 1), which may dictate the action a player may take during the player's turn. In various embodiments, play selectors may be comprised in a die or dice (comprising any suitable number of sides) wherein each side of the die or dice comprises a play selector. A player may role the die or dice, and whichever play selector(s) is face up in response to the die or dice coming to rest, that dictates the action the player may take during his or her turn. In various embodiments, play selectors may be comprised in a spinner comprising a pointer and a chart, wherein each portion of the chart may comprise a play selector. The pointer and/or the chart may be spun, and whichever play selector the pointer is resting on after coming to rest dictates the action the player may take during his or her turn. In various embodiments, the play selectors may be a plurality of cards, such as those depicted in FIG. 4, wherein each card dictates the action the player may take during his or her turn. In various embodiments, game system 200 may comprise a plurality of cards having any suitable number of cards, such as between 30 and 60. Each player may be dealt a pre-determined number or set of cards at the beginning of a game and play them throughout the game, and/or each player may draw one or more cards during each turn. In various embodiments, the play selectors of game system 200 may comprise one or more of the various play selectors described herein.

Figure 4:
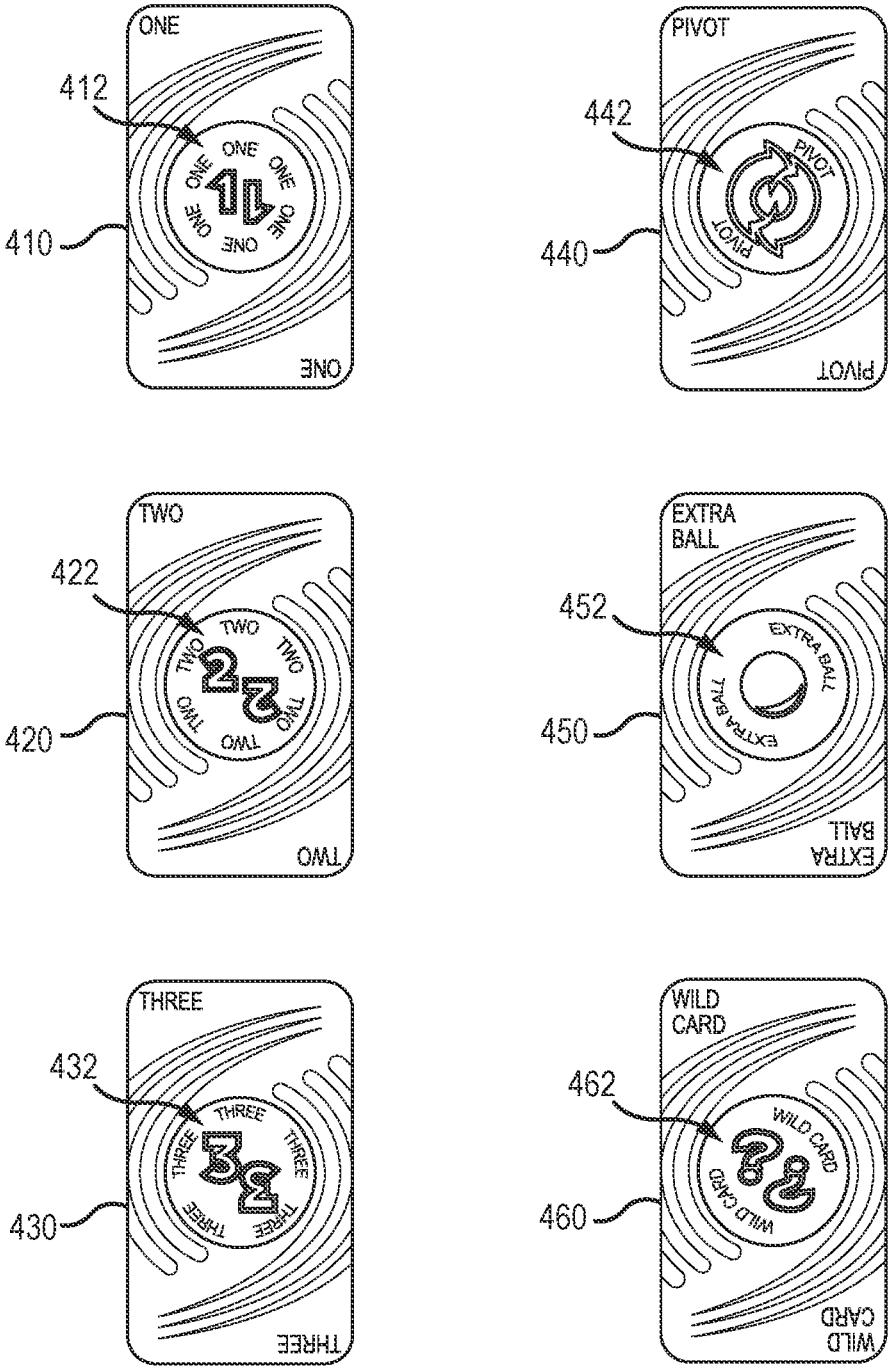
FIG. 4 depicts exemplary play selectors for a game system, in accordance with various embodiments.

In accordance with various embodiments, FIG. 4 depicts cards as play selectors of game system 200. With combined reference to FIGS. 2A-4, play selectors 410, 420, and 430 dictate which action a player of game system 200 may take in their turn. In various embodiments, play selectors may tell a player which deflector size (or number of connected single deflectors 310) to play during a turn. Play selector 410, with display 412, indicates that a player may place a single deflector 310 on board plane 212 between two adjacent pegs 214. Play selector 420, with display 422, indicates that a player may place a double deflector 320 on board plane 212, or, in various embodiments, two single deflectors 310 sharing one common peg 214. Play selector 430, with display 432, indicates that a player may place a triple deflector 330 on board plane 212, or, in various embodiments, three single deflectors 310 wherein each single deflector 310 shares one peg 214 in common with at least one other single deflector 310.

In various embodiments, the play selectors may tell a player actions to take during a turn while playing game system 200, other than, or in addition to, playing a deflector. For instance, play selector 440, with display 442, indicates that a player may pivot a deflector already disposed on board plane 212. Play selector 440 may allow a player, in various embodiments, to pivot a deflector about any peg 214 to which the deflector is coupled. For example, double deflector 320 may be pivoted by a player having played or received play selector 440 about any of the three peg voids 342 in double deflector 320. Additionally, in embodiments comprising multiple single deflectors 310 being coupled together sharing common pegs 214, or with deflectors comprising hinges, as discussed herein, a player may pivot a portion of a deflector (e.g., one single deflector 310 of a chain of single deflectors 310) about one or more of the hinges or common pegs 214. In various embodiments, a play selector may allow a player to move or remove a deflector on board plane 212.

Play selector 450, with display 452, may allow a player to roll one or more extra balls 250 at the end of a turn from start end 206 of board plane 212 (or at any suitable point during a turn). In various embodiments, the extra ball(s) may be used during the turn in which the player played or received play selector 450, or the player may save the extra ball(s) to play during the turn of his or her choosing, or replay a ball if a desired result was not achieved with a previous ball. In various embodiments, play selector 450 may also allow a player to play a deflector on board plane 212. The deflector may be chosen by the player (i.e., whatever the player wants, or playing a play selector indicating a deflector that the player possesses), or the player may receive another play selector indicating what type of deflector may be played.

Play selector 460, with display 462, may allow a player to take any action offered by any of the other play selectors (a "wild card"). For example, play selector 460 may allow a player to place any type of deflector on board plane 212, play an extra ball, pivot, move, or remove a deflector already on board plane 212, or any combination thereof.

As described herein, in various embodiments, the play selector(s) of game system 200 may be a die or die in which one or more of the sides of the die or dice may reflect one or more of the actions reflected on play selectors 410-460, a spinner in which one or more sections of a chart may reflect one or more of the actions reflected on play selectors 410-460, or any other suitable game selector type. In various embodiments, the play selectors may indicate actions a player may take other than, or in addition to, the actions reflected on play selectors 410-460. For example, a play selector may allow a player to remove or move a deflector, choose a ball type (e.g., choose a ball shape and/or material), add, remove, or move a goal 240, change angle 235 of board plane 212 (e.g., increase or decrease angle 235 (depicted in FIG. 2B)) relative to horizontal, move the position of an offset row 218, or any other possible move that may affect the outcome of playing game system 200.

Figure 5:
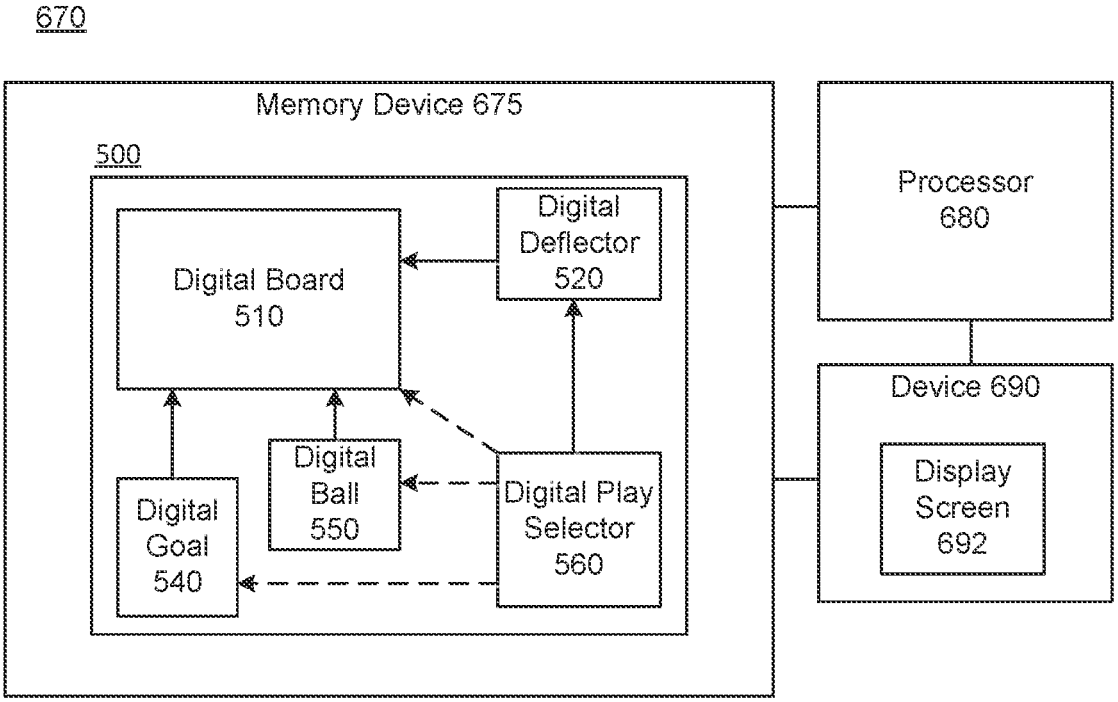
FIG. 5 depicts a system including a digital game system, in accordance with various embodiments.

While FIGS. 2A-4 depict game system 200 as a physical system, it should be understood that in various embodiments, game system 200 and/or game system 100 may be digitally implemented. With reference to FIG. 5, a system 670 may be computer-based, and may comprise a processor 680, a tangible non-transitory computer-readable memory device, a network interface, and/or a device 690. Instructions stored on memory device 675 may allow system 670 to perform various functions, as described herein. Processor 680, memory device 675, and/or device 690 having a display screen 692, may be in operable communication with one another. Memory device 675 may comprise a digital game system 500 and its components (similar to the components of game systems 100 depicted in FIG. 1), including a digital board 510, at least one digital deflector 520, at least one digital goal 540, at least one digital ball 550, and/or at least one digital play selector 560. Device 690 may be any device such as a personal computer, mobile device, tablet, etc.

Figure 6A:
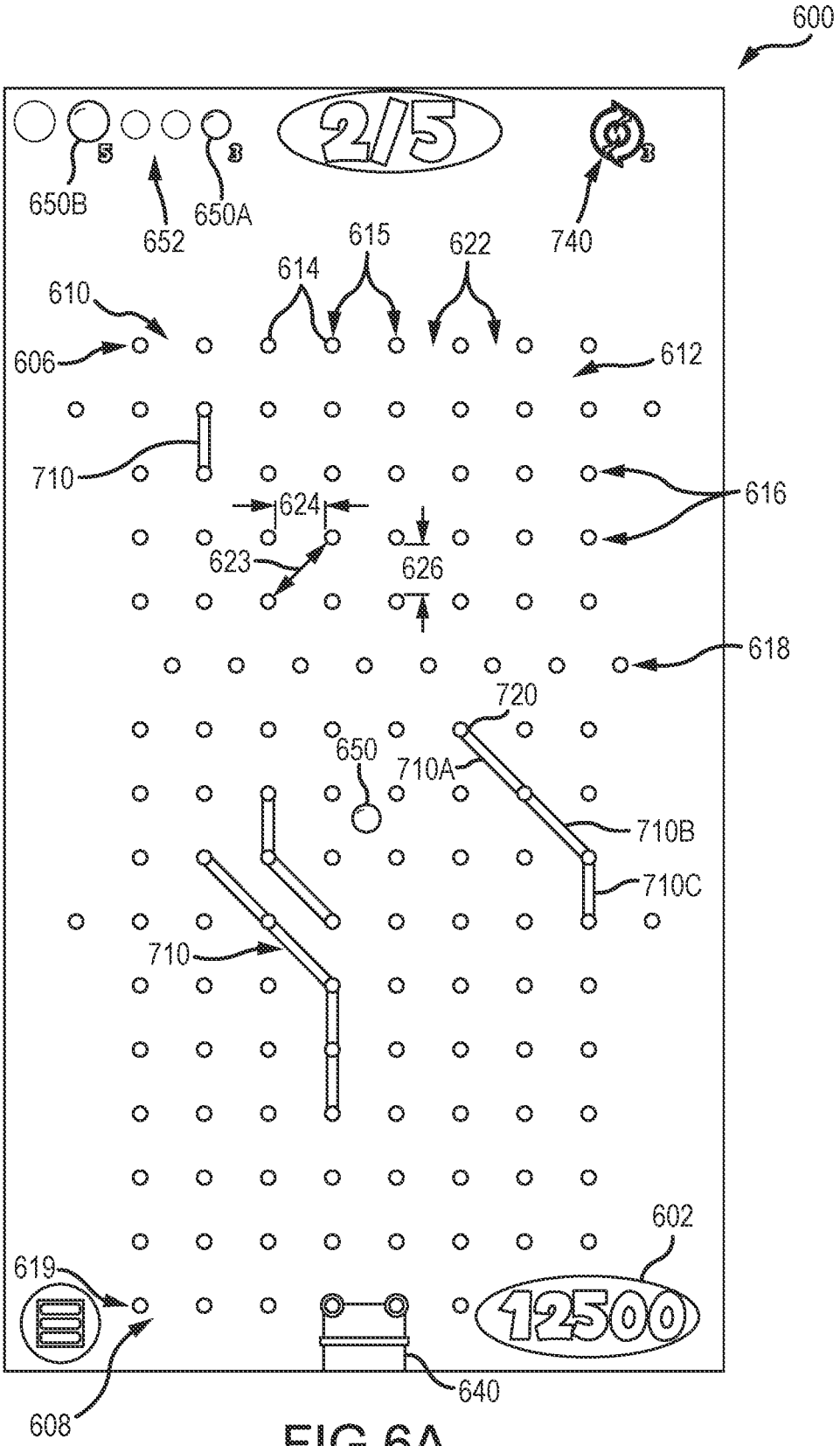
FIGS. 6A and 6B depict a game system, in accordance with various embodiments.
Figure 6B:
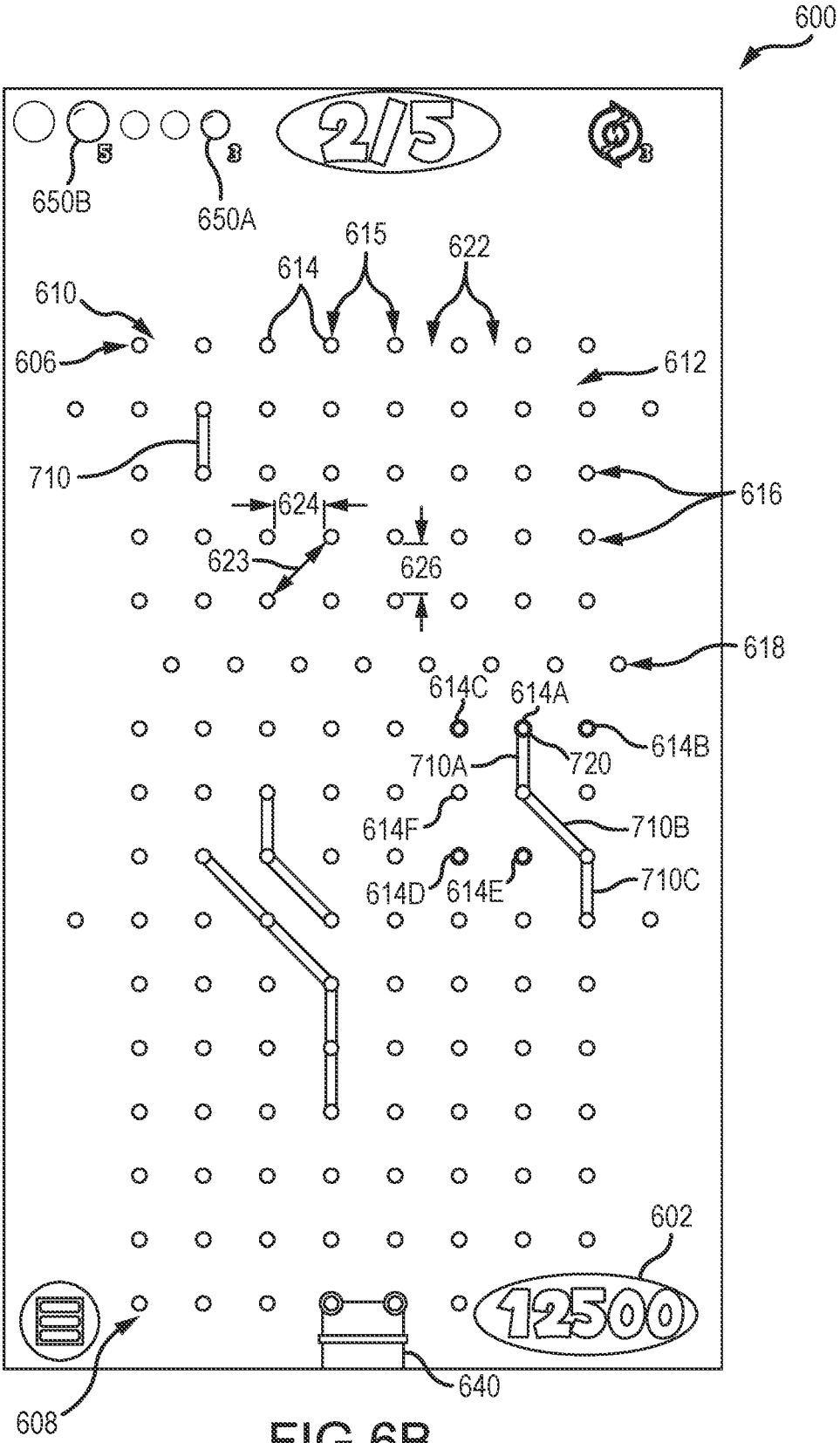

In various embodiments, processor 680 may cause the components of digital game system 500 to interact with one another, and may receive commands from a player playing digital game system 500 on a device 690, which processor 680 may execute. For example, display screen 692 on device 690 may display the components of digital game system 500. Digital game system 500 may be displayed as game system 600, as depicted in FIGS. 6A and 6B, in accordance with various embodiments. Similar to game system 200 in FIG. 2A, game system 600 may have a board 610 (an example of digital board 510) and a plurality of pegs 614 coupled to a board plane 612 disposed in rows 616. Rows 616 may span between the outer edges of board plane 612. Pegs 614 in one row 616 may be aligned with pegs 614 in one or more other rows 616 such that some or all of pegs 614 in rows 616 create cross rows 615 spanning between start end 606 and goal end 608 of board plane 612. The arrangement of pegs 614 to form cross rows 615 may create pathways 622 between cross rows 615 in which ball 650 (an example of digital ball 550 in FIG. 5) may traverse or move along board plane 612. In various embodiments, a point(s) may be awarded to a player for each peg 614 that ball 650 contacts while traveling toward goal end 608.

In various embodiments, with reference to FIGS. 5, 6A, and 6B, at least one of rows 616 may be an offset row 618, similar to offset row 218 in game system 200 (FIG. 2A). In various embodiments, game system 600 may comprise one or more goals 640 (an example of a digital goal 540) disposed in a goal row 619 of rows 616. In various embodiments, one or more deflectors 710 (an example of a digital deflector 520) may be disposed on board plane 612, which may be coupled to pegs 614 in any suitable manner, such as those depicted in FIGS. 6A and 6B. Similar to the deflectors discussed in relation to game system 200, the deflectors of game system 600 may be single, double, or triple deflectors, or multiple connected deflectors such that the multiple single deflectors may span in any desired direction (e.g., diagonal direction 623, horizontal direction 624, and/or vertical direction 626). The components of digital game system 500 and game system 600 may comprise the same or similar characteristics and interactions between the components as described herein in relation to game system 200 in FIG. 2A, but such characteristics of, and interactions between, the components of digital game system 500 and game system 600 may be implemented digitally rather than physically.

With continued reference to FIGS. 5, 6A, and 6B, a player of game system 600 may receive one or more play selectors each representing an action to take during a turn. In various embodiments, a play selector for game system 600 (i.e., a digital play selector 560 for digital game system 500 of FIG. 5) may be similar to those depicted and described in relation to game system 200 and FIG. 4. The player may select a digital play selector 560 for his or her turn by, for example, pushing a button or area on a touch screen on device 690 (display screen 692 may also comprise a touch screen). In various embodiments, game system 600 may comprise pivot play selector 740 (an example of a digital play selector 560), which a player may select to pivot a deflector already on board plane 612. For example, a player may select pivot play selector 740 and pivot single deflector 710A, which is coupled to single deflectors 710B and 710C, such that deflector end 720 is moved to any one of pegs 614A-E, or any other suitable peg 614. Pegs 614 to which deflector end 720 may be moved may be illuminated or otherwise marked indicating such a peg's availability to receive deflector end 720. As depicted in FIG. 6B, for example, peg 614F may not be available to receive deflector end 720, and therefore, is not displayed like pegs 614A-E. In various embodiments, peg 614F may be available to receive deflector end 720.

Additionally, in various embodiments, game system 600 may comprise a ball type play selector (another example of a digital play selector 560), through which a player may select a ball, such as between ball types 650A and 650B. In addition to the play selectors described herein related to play selector(s) of game system 200, digital play selectors 560 may allow a player to change the size of a digital goal 540 and/or digital deflector 520, add, remove, move, or change pegs 214, add, remove, move, or change an offset row(s) 218 (e.g., make the offset row 618 comprise offset pegs 614 for only half of the length of the row of pegs 614), change rolling speed of a digital ball 550, or other actions not feasible in a physical embodiments of a game system 200. Processor 680, in response, may cause the action associated with the selected digital play selector 560 to take place in digital game system 500.

In various embodiments, components of digital game system 500 and game system 600 may have characteristics different from, or in addition to, a physical embodiment of the game system (e.g., game system 200). For example, digital ball(s) 550 may comprise different types with different characteristics. One digital ball 550 type may be a standard digital ball 550 (e.g., ball 650A in FIG. 6A) that will behave similarly to a physical ball being utilized in game system 200 (i.e., resembling regular physical reactions while moving from start end 606 to goal end 608 of board plane 612 with board plane 612, pegs 614, and/or deflectors). Another digital ball type may be a wrecking ball (e.g., ball 650B in FIG. 6A), which may be capable of breaking a deflector in response to contacting a deflector. Another digital ball type may comprise a bouncy ball, which displays elastic characteristics (i.e., exaggerated physical reactions, or a spring effect, in response to contacting pegs 614 and/or deflectors). Yet another digital ball 550 type may be a stretch ball that may transform into a deflector in response to reaching a certain point on the board plane of board plane 612, or in response to a player selecting a time or location for the stretch digital ball 550 to transform into a deflector. Yet another digital ball 550 type may be a jumper ball, which may be able to be released on any point on board 610 to move toward goal end 608. In various embodiments, game system 600 may display for the player how many of each type of ball 650 the player has left in a ball display 652.

In various embodiments, with reference to FIGS. 5 and 6A, digital deflector(s) 520 in digital game system 500 (e.g., deflectors 710 in game system 600) may comprise various characteristics including elasticity (a spring effect in response to a digital ball 550 contacting the digital deflector 520), hardness or high friction (a suppressed bounce effect, or speed reduction effect, in response to a digital ball 550 contacting the digital deflector 520), standard characteristics (resembling normal physical reactions in response to a digital ball 550 contacting digital deflector 520), or any other desired characteristics. In various embodiments, digital deflector 520 may move along board plane 612 or break, in response to digital ball 550 contacting digital deflector 520).

In various embodiments, game system 600 may display the number of points a player has on scoreboard 602.

Figure 7:
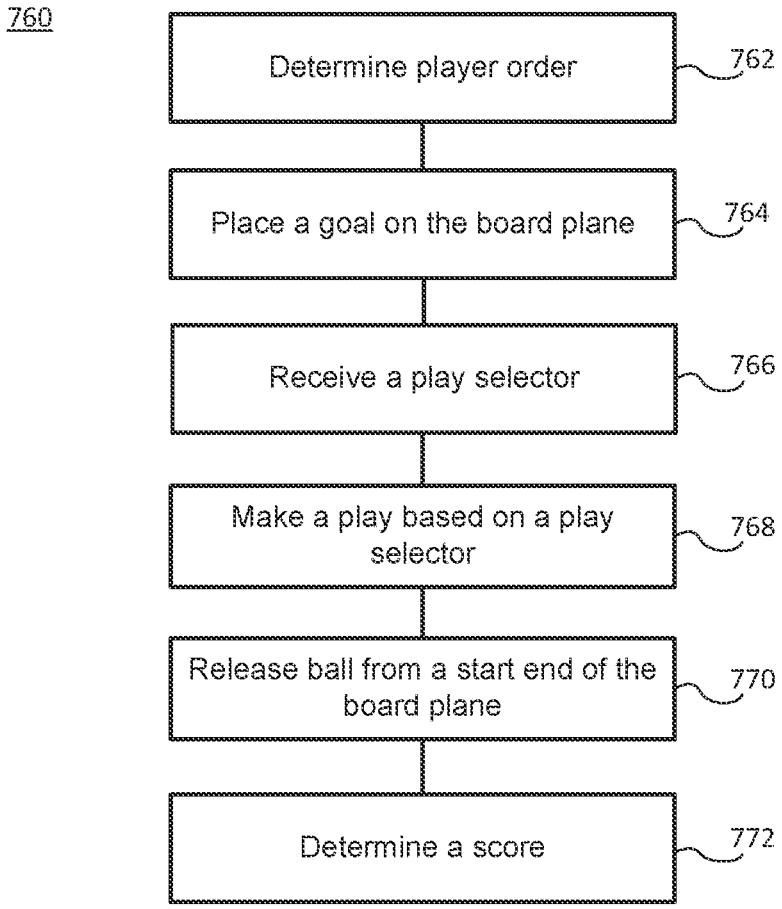
FIG. 7 depicts a flowchart of an exemplary method of playing a game system, in accordance with various embodiments.

FIG. 7 depicts an exemplary method 760 of playing game system 100 (FIG. 1), and/or digital game system 500 (FIG. 5), in accordance with various embodiments. Method 760 is described herein in relation to the components of game system 100 and/or game system 200. However, it should be understood that method 760 may be implemented with digital game system 500 and game system 600 and the components that correspond to the components of game system 200. Game system 100 and/or digital game system 500 (including game system 200 in FIG. 2A, and/or game system 600 in FIG. 6A) may be played with at least one player. With combined reference to FIGS. 2A-7, in response to multiple players playing game system 200 (600), a player order may be determined (step 762). Player order may be decided by rolling a die, drawing a card, spinning a spinner, and the player receiving the highest (or lowest, or closest to a specific number or play selector type) may go first, or choose the order. Player order may be chosen at random, or by any other suitable method.

In various embodiments, a goal 240 (640) may be placed on board plane 212 (612) (step 764). In various embodiments, as described herein, goal(s) 240 (640) may be placed anywhere on board plane 212 (612), such as at or near goal end 208 (608). There may be one goal 240 (640) placed on board plane 212 (612) no matter how many players are playing game system 200 (600), or one goal 240 (640) for each player, or any desired number of goals 240 (640). In various embodiments, a player may determine where on board plane 212 (612), or along goal row 219 (619), to place a goal(s) 240 (640). In various embodiments, goal(s) 240 (640) may be disposed on board plane 212 (612) automatically (e.g., according to game rules, and/or by processor 680 for digital game system 500 and game system 600).

In various embodiments, a player(s) may receive a play selector (step 766). A player(s) may receive a set amount of play selectors, such as play selectors 410-460, at the beginning of a game, or a player(s) may receive one or more play selectors each turn. For example, a player(s) may receive a play selector each turn by rolling a die or dice, spinning a spinner, and/or drawing a card. In digital game system 500 and game system 600, a player may automatically receive one or more play selectors, such as pivot play selectors 740 and/or ball type play selectors, which may be assigned by processor 680. For example, a player may receive at least one pivot play selector 740, with which a player may pivot a deflector 710 on board plane 612 in any way described herein. As another example, a player may receive at least one ball type play selector, with which the player may select which type of digital ball 650 to play during a turn.

In various embodiments, steps 762-766 may take place in any suitable order. The player(s) may be able to pick at least one play selector to play during a turn in response to having multiple play selectors at one time, or the player(s) may play the play selector received during that turn. In any event, the player(s) may play make a play based on a play selector (step 768).

In response to playing a play selector, a ball 250 (650) may be released from start end 206 (606) of board plane 212 (612) (step 770). The ball 250 (650) may be released from any point on start end 206 (606) selected by the player. The ball 250 (650) may be released from start end 206 (606) by a player after that player has made his or her play for the turn, or each player may release a ball 250 (650) from start end 206 (606) after all players has made their plays for the turn. For digital game system 500 and game system 600, processor 680 may release a ball 650 from start end 606 in response to receiving an action command to do so from the player. The balls 250 (650) may be released simultaneously, or in any order (e.g., in the order that the players made their plays for the turn). The ball type released (i.e., made of different materials, or having various characteristics, as described herein) may be chosen by the player and/or may be dictated by a play selector. The ball 250 (650) may move along board plane 212 (612) in response to being released from start end 206 (606), interacting with pegs 214 (614) and/or deflectors while moving toward goal end 208 (608). Upon reaching goal end 208 (608), ball 250 (650) may come to rest inside or outside of a receptacle area 241 of a goal 240 (640), and a score may be determined (step 772). In response to a ball 250 (650) coming to rest inside of a receptacle area 241 of a goal 240 (640), the player associated with that goal 240 (640) may receive a point or a number of points. No point(s) may be awarded in response to a ball 250 (650) coming to rest outside of a receptacle area(s) 241 of a goal(s) 240 (640). There may be a set number of turns (i.e., any desired number), and upon conclusion of the last turn, the player with the most points may be declared the winner.

As a summary of game play of game system 200 with reference to FIG. 2A, which also may be played on game system 600 of FIGS. 6A and 6B, multiple players may be playing. During each turn, each player may play a play selector and the play associated with the play selector. For example, a first player may receive and/or play a play selector 420, and in response, place a double deflector 320 on board plane 212 in a position that will at least one of direct a ball toward a goal 240 associated with the first player, or direct a ball 250 away from a goal 240 associated with another player. A second player may receive or play a play selector, such as play selector 440. In response to playing play selector 440, as an example, the second player may pivot double deflector 320 played by the first player, or any other deflector already disposed on board plane 212. The second player may pivot a deflector to benefit him or her (i.e., so the pivoted deflector contributes to guiding a ball toward a goal 240 associated with the second player, or guides a ball away from a goal 240 associated with another player). Any additional players may receive and/or play a play selector during the turn and make the play associated with the play selector.

In various embodiments, in response to all players taking action(s) related to the play selectors during a turn, each player may release a ball 250 from start end 206 of board plane 212. The ball 250 may be released anywhere along start end 206. The balls 250 may be released one-at-a-time or simultaneously, or in any desired timing scheme. In response to the balls 250 reaching goal end 208, a point or a number of points is awarded for each ball that landed in a goal 240 associated with each player. Returning to the example with a first and second player, if one ball lands in a goal 240 associated with the first player, and the second ball does not land in a goal 240, one point (or a number of points) is awarded to the first player. At the conclusion of a number of turns, which ever player has the most points wins the game. In various embodiments, the number of turns may be determined by game rules, or by the number of play selectors given to each player at the beginning of a game (i.e., if each player receives six play selectors, for example cards, at the beginning of the game, the game may have six turns).

In various embodiments, game system 100 and/or digital game system 500 may comprise levels, which a player may complete to move to another level. In such embodiments, one or more players may play the levels, but for simplicity sake, such embodiments will be explained with a single player. With reference to game system 600 in FIGS. 6A and 6B (though such embodiments may be implemented with game system 200 of FIG. 2A), each level may have a predetermined configuration of a deflector(s) 710 and one or more goals 640 already disposed on board plane 612. Accordingly, the player may be able to dispose few or no additional deflectors on board plane 612 to supplement the deflectors already placed on board plane 612. The player may receive a pre-determined number of balls 650, and a pre-determined number of play selectors (e.g., pivot play selectors 740 similar to play selector 440 in FIG. 4, different types of balls in a ball display 652 such as those discussed herein, a play selector allowing movement of a goal 640, etc.). In various embodiments, the player may earn and/or receive additional balls or play selectors. The number of balls 650 the player receives is the number of turns in a level. During each turn (one ball 650 may be released from start end 606 of board plane 612 at the end of each turn), the player may player one or more play selectors. For example, the player may play a pivot play selector 740 and pivot a portion of a deflector 710 disposed on board plane 612 about one of the pegs 614 to which the deflector is coupled, such that at least one portion of the pivoted deflector is disposed in a different direction. After the player has completed his or her plays (e.g., pivoting/moving deflectors, moving goals, or the like), the player may select a ball type, and select a place along start end 606 to release the ball 650. The player may release the ball 650, and the ball 650 may interact with the deflector(s) and pegs 614 as it moves to goal end 608. Interactions between the ball 650 and the deflector(s) and pegs 614 may be different based on the ball type, deflector type, and/or peg type as discussed herein, especially relating to digital game system 500 and game system 600.

The object of each level may be to get a required number of balls 650 into the goal(s) 640 disposed on board plane 612 and/or a required number of points for each specific level. For example, a level may require the player to get two balls 650 in a single goal 640 (i.e., score two goals). Therefore, based on the number of balls 650 the player is given at the beginning of the level, he or she will have that many attempts, while playing the play selectors provided, to get the required two goals. In response to meeting the requirements set by the level, the player may move onto a subsequent level, which may be of greater difficulty.

Figure 8:
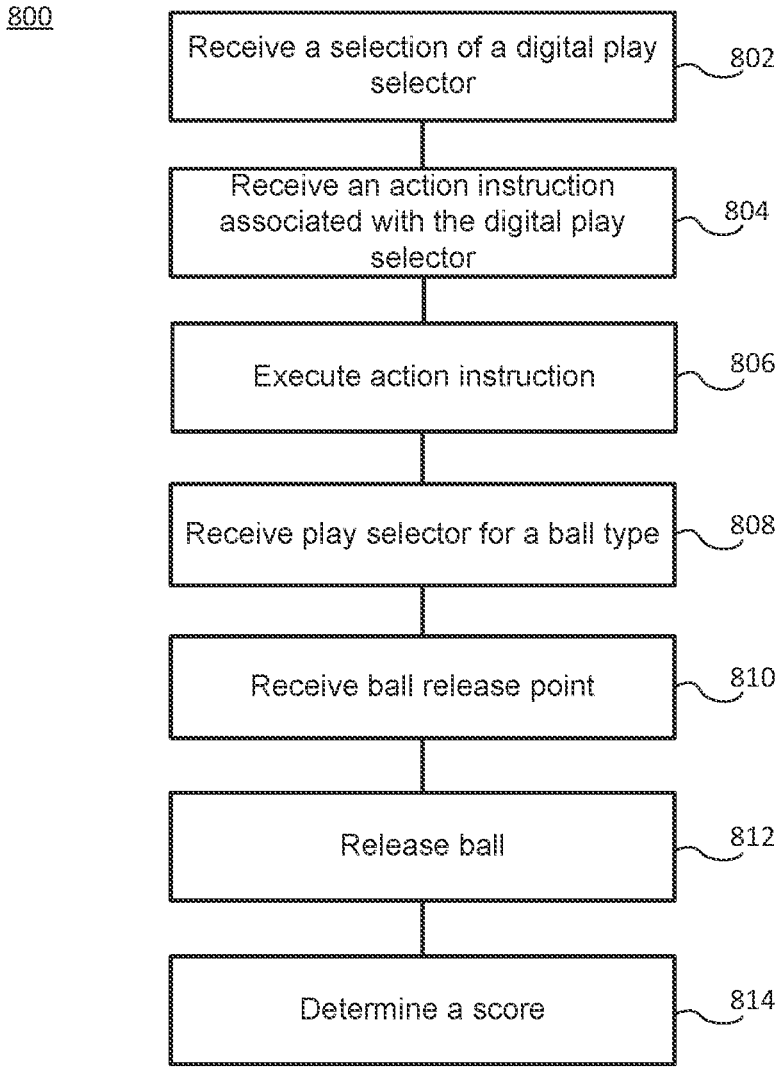
FIG. 8 depicts a method for playing a digital game system, in accordance with various embodiments.

With reference to FIGS. 5, 6, and 8, a method 800 for playing digital game system 500 and game system 600 is depicted, in accordance with various embodiments. In various embodiments, processor 680 may display game system 600 on display screen 692 of a device 690. Game system 600 may comprise a board 610 with deflector(s) 710 and/or a goal(s) 640 disposed on board plane 612, or board 610 may be blank. A player of game system 600 may receive one of more play selectors which may allow a player to, for example, select a digital ball type, select and/or place a deflector 710 type on board 610, pivot, move, or remove a deflector 710 on board 610, receive an additional ball 650 and/or deflector 710, move or change a goal 640, or the like. Symbols on display screen 692 may indicate each play selector obtained by the player. The player may select the symbol associated with a desired digital play selector 560 by pressing a button or contacting a touch screen in the correct area. System 670 may receive the selection of a digital play selector 560 (step 802) (e.g., a pivot play selector 740 or ball type play selector). In response to selecting a digital play selector 560, the player may give an action instruction regarding how to make the play associated with the selected digital play selector 560. For example, if the player selected a pivot play selector 740, the player may then instruct system 670 how to make the play (pivot a deflector), by an action instruction dictating which digital deflector, which part of the digital deflector to be pivoted, and/or in which direction. The player may give an action instruction by pushing buttons and/or pushing and/or dragging along a touch screen of device 690. System 670 may receive the action instruction associated with the digital play selector 560 (step 804) chosen by the player. In response, system 670 may execute the action instruction (step 806) by, for example, placing a deflector 710, pivoting a deflector 710, etc. on board 610. For example, as depicted in FIGS. 6A and 6B, deflector 710A may be moved from peg 614C to peg 614A.

In various embodiments, in response to the player(s) playing the a digital play selector(s) 560 associated with placing and/or pivoting deflectors 710 on board 610, the player may select a ball type play selector for a ball type (e.g., a standard ball 650A, wrecking ball 650B, bouncy ball, stretch ball, etc.). In response, system 670 may receive digital play selector 560 for the ball type (step 808). The player may also select a point on start end 606 from which ball 650 should be released to travel toward goal end 608, and in response, system 670 may receive the ball 650 release point (step 810). System 670 may release ball 650 (step 812)

from the release point along start end 606, and in response, ball 650 will move toward goal end 608, interacting with deflectors 710 and/or pegs 614.

In various embodiments, goal end 608 will comprise one or more goals 640. Based on where the ball 650 lands in goal end 608, system 670 will determine a score (step 814). In response to ball 650 landing in a goal 640, a point or a number of points may be awarded to the player. In response to ball 650 failing to land in a goal 640, points may not be awarded to the player.

In various embodiments, steps 802-810 may be executed in any suitable order. For example, in various embodiments, system 670 may receive a ball release point (step 810) before receiving a ball type play selector (step 808), or system 670 may receive a play selector for a ball type (step 808) before any other steps take place. In various embodiments, method 800 may be repeated until a player has received enough goals and/or points to complete a level, and then method 800 may be utilized to complete a subsequent level. In various embodiments, method 800 may be repeated until a number of turns are over (e.g., each player has played the number of play selectors and/or balls he or she received). Upon completion of the number of turns, a score may be declared, resulting in a winner in a multi-player game, or resulting in the completion or failure of the present level.

The game and game components disclosed herein, in both physical and electronic versions, may incorporate reasonable design parameters, features, modifications, advantages, and variations that are readily apparent to those skilled in the art in the field of the game design and/or board game industry.

Without departing from the scope and spirit of the present invention, reasonable features, modifications, advantages, and design variations of the claimed invention will become readily apparent to those skilled in the art by following the guidelines set forth in the preceding detailed description and embodiments.

It is understood that although a number of different embodiments of the game system described herein and corresponding method of playing the game system have been illustrated and described herein, one or more features of any one embodiment can be combined with one or more features of one or more of the other embodiments, provided that such combination satisfies the intent of the present invention.

While a number of exemplary aspects and embodiments of the game system and corresponding method of play have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Systems, methods and computer program products are provided. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

In various embodiments, the methods described herein relating to system 670 are implemented using the various particular machines described herein. The methods described herein may be implemented using particular machines discussed herein, and those hereinafter developed, in any suitable combination, as would be appreciated immediately by one skilled in the art. Further, as is unambiguous from this disclosure, the methods described herein may result in various transformations of certain articles.

For the sake of brevity, conventional data networking, application development and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical system.

The various system components of system 670 discussed herein may include one or more of the following: a host server or other computing systems including a processor for processing digital data; a memory coupled to the processor for storing digital data; an input digitizer coupled to the processor for inputting digital data; an application program stored in the memory and accessible by the processor for directing processing of digital data by the processor; a display device coupled to the processor and memory for displaying information derived from digital data processed by the processor; and a plurality of databases. As those skilled in the art will appreciate, user computer may include an operating system (e.g., WINDOWS®, OS2, UNIX®, LINUX®, SOLARIS®, MacOS, etc.) as well as various conventional support software and drivers typically associated with computers.

In fact, in various embodiments, various embodiments are directed toward one or more computer systems capable of carrying out the functionality described herein. The computer system includes one or more processors, such as processor. The processor is connected to a communication infrastructure (e.g., a communications bus, cross-over bar, or network). Various software embodiments are described in terms of this exemplary computer system. After reading this description, it will become apparent to a person skilled in the relevant art(s) how to implement various embodiments using other computer systems and/or architectures. Computer system can include a display interface that forwards graphics, text, and other data from the communication infrastructure (or from a frame buffer not shown) for display on a display unit.

The terms "computer program medium" and "computer usable medium" and "computer readable memory" are used to generally refer to media such as removable storage drive and a hard disk installed in hard disk drive. These computer program products provide software to computer system.

Computer programs (also referred to as computer control logic) are stored in main memory and/or secondary memory. Computer programs may also be received via communications interface. Such computer programs, when executed, enable the computer system to perform the features as discussed herein. In particular, the computer programs, when executed, enable the processor to perform the features of various embodiments. Accordingly, such computer programs represent controllers of the computer system.

In various embodiments, software may be stored in a computer program product and loaded into computer system using removable storage drive, hard disk drive or communications interface. The control logic (software), when executed by the processor, causes the processor to perform the functions of various embodiments as described herein. In various embodiments, hardware components such as application specific integrated circuits (ASICs). Implementation of the hardware state machine so as to perform the functions described herein will be apparent to persons skilled in the relevant art(s).

As those skilled in the art will appreciate, a device (e.g., device 690) includes an operating system (e.g., WINDOWS®/CE/Mobile, OS2, UNIX®, LINUX®, SOLARIS®, MacOS, etc.) as well as various conventional support software and drivers typically associated with computers. A device may include any suitable personal computer, network computer, workstation, personal digital assistant, cellular phone, smart phone, minicomputer, mainframe or the like. A device can be in a home or business environment with access to a network. In various embodiments, access is through a network or the Internet through a commercially available web-browser software package. A device may implement security protocols such as Secure Sockets Layer (SSL) and Transport Layer Security (TLS). A device may implement several application layer protocols including http, https, ftp, and sftp.

The systems and methods may be described herein in terms of functional block components, screen shots, optional selections and various processing steps. It should be appreciated that, relating to system 670, such functional blocks may be realized by any number of hardware and/or software components configured to perform the specified functions. For example, the system may employ various integrated circuit components, e.g., memory elements, processing elements, logic elements, look-up tables, and the like, which may carry out a variety of functions under the control of one or more microprocessors or other control devices. Similarly, the software elements of the system may be implemented with any programming or scripting language such as C, C++, C #, JAVA®, JAVASCRIPT, VBScript, Macromedia Cold Fusion, COBOL, MICROSOFT® Active Server Pages, assembly, PERL, PHP, awk, Python, Visual Basic, SQL Stored Procedures, PL/SQL, any UNIX shell script, and extensible markup language (XML) with the various algorithms being implemented with any combination of data structures, objects, processes, routines or other programming elements.

Various systems and methods described herein with reference to screen shots, block diagrams and flowchart illustrations of methods, apparatus (e.g., systems), and computer program products according to various embodiments. It will be understood that each functional block of the block diagrams and the flowchart illustrations, and combinations of functional blocks in the block diagrams and flowchart illustrations, respectively, can be implemented by computer program instructions.

The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re *Nuijten* to fall outside the scope of patentable subject matter under 35 U.S.C. § 101.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A game system, comprising:

a board comprising a plurality of pegs disposed in a plurality of rows spanning between outer edges of the board, wherein the plurality of pegs in the plurality of rows are aligned such that the plurality of pegs are disposed in a plurality of cross rows spanning between a start end and a goal end of the board, with pathways between the cross rows, and wherein a minimum of one and a maximum of four of the plurality of rows are offset rows, wherein an offset row comprises a plurality of offset pegs each disposed within a respective pathway of the pathways between the cross rows;

at least one deflector coupled to at least two pegs of the plurality of pegs aligned with one another, wherein the at least one deflector comprises at least one deflector peg void disposed in the at least one deflector, wherein the at least one deflector peg void is disposed about at least one of the at least two pegs; and at least one goal coupled to at least two other pegs of the plurality of pegs, wherein the goal comprises at least one goal peg void, wherein the at least one goal peg void is disposed about at least one of the at least two other pegs.

2. The game system of claim 1, wherein the at least one goal is coupled to the at least two other pegs in a goal row of the plurality of rows, wherein the goal row is disposed at the goal end of the board.

3. The game system of claim 1, wherein the at least one deflector is at least one of a single deflector coupled to two adjacent pegs of the plurality of pegs, a double deflector coupled to three aligned pegs of the plurality of pegs, or a triple deflector coupled to four aligned pegs of the plurality of pegs.

4. The game system of claim 3, wherein a double deflector comprises two single deflectors that share a first common peg of the three aligned pegs, and wherein a triple deflector comprises three single deflectors, wherein each of the three single deflectors shares a second common peg with at least one other of the three single deflectors.

5. The game system of claim 1, wherein the board is disposed at an angle relative to a horizontal plane, wherein the angle is between about 10 degrees and about 60 degrees.

6. The game system of claim 1, wherein the at least one goal comprises a single piece of material forming a receptacle area between the at least two pegs.

7. The game system of claim 1, wherein the at least one goal is U-shaped.

8. A game system, comprising:

a board comprising a plurality of pegs disposed in a plurality of rows spanning between outer edges of the board, wherein the plurality of pegs in the plurality of rows are aligned such that the plurality of pegs are disposed in a plurality of cross rows spanning between a start end and a goal end of the board, with pathways between the cross rows, and wherein a minimum of one and a maximum of four of the plurality of rows are offset rows, wherein an offset row comprises a plurality of offset pegs each disposed within a respective pathway of the pathways between the cross rows;

at least one removable deflector coupled to at least two pegs of the plurality of pegs aligned with one another; and at least one removable goal wall coupled to at least two other pegs of the plurality of pegs.

9. The game system of claim 8, wherein the at least one removable deflector is at least one of a single deflector coupled to two adjacent pegs of the plurality of pegs, a double deflector coupled to three aligned pegs of the plurality of pegs, or a triple deflector coupled to four aligned pegs of the plurality of pegs.

10. The game system of claim 8, wherein the at least one removable goal wall is coupled to the at least two other pegs in a goal row of the plurality of rows, wherein the goal row is disposed at the goal end of the board.

11. The game system of claim 8, wherein the at least one removable goal wall is U-shaped.

12. The game system of claim 8, wherein the board is disposed at an angle relative to a horizontal plane, wherein the angle is between about 10 degrees and about 60 degrees.

13. A system, comprising:

a processor;

a tangible, non-transitory memory configured to communicate with the processor, the tangible, non-transitory memory having instructions stored thereon that, in response to execution by the processor, cause the processor to perform operations comprising:

displaying, by the processor and on a display screen of a device, a digital game system comprising:

a digital board comprising a plurality of digital pegs, wherein the plurality of digital pegs are disposed in a plurality of rows spanning between outer edges of the digital board, wherein the plurality of digital pegs in the plurality of rows are aligned such that the plurality of digital pegs form cross rows spanning between a start end and a goal end of the digital board, with pathways between the cross rows, and wherein a minimum of one and a maximum of four of the plurality of rows are offset rows, wherein an offset row comprises a plurality of offset digital pegs each disposed within a respective pathway of the pathways between the cross rows; and at least one digital deflector spanning at least partially between at least two digital pegs of the plurality of digital pegs aligned with one another.

14. The system of claim 13, further comprising at least one digital goal spanning at least partially between at least two other digital pegs of the plurality of digital pegs.

* * * * *